US009959999B2

(12) United States Patent
Adachi et al.

(10) Patent No.: US 9,959,999 B2
(45) Date of Patent: May 1, 2018

(54) METHOD FOR CONTROLLING POWER SWITCHING APPARATUS

(71) Applicant: Hitachi, Ltd., Chiyoda-ku, Tokyo (JP)

(72) Inventors: Koichiro Adachi, Tokyo (JP); Hajime Urai, Tokyo (JP); Katsuhiko Shiraishi, Tokyo (JP); Masataka Sasaki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 130 days.

(21) Appl. No.: 15/176,869

(22) Filed: Jun. 8, 2016

(65) Prior Publication Data

US 2016/0365206 A1 Dec. 15, 2016

(30) Foreign Application Priority Data

Jun. 9, 2015 (JP) ..... 2015-116430

(51) Int. Cl.

| | |
|---|---|
| ***H01H 33/59*** | (2006.01) |
| ***H01H 33/36*** | (2006.01) |
| *H01H 11/00* | (2006.01) |
| *H01H 3/26* | (2006.01) |

(52) U.S. Cl.

CPC ..... *H01H 33/593* (2013.01); *H01H 33/36* (2013.01); *H01H 11/0062* (2013.01); *H01H 2003/268* (2013.01)

(58) Field of Classification Search

None

See application file for complete search history.

(56) References Cited

U.S. PATENT DOCUMENTS

| | | | | |
|---|---|---|---|---|
| 4,559,424 | A * | 12/1985 | Lorenz | H01H 33/12 218/13 |
| 5,321,221 | A * | 6/1994 | Rozier | H01H 1/5833 218/2 |
| 6,531,841 | B1 * | 3/2003 | Elli | H01H 33/36 318/265 |
| 6,545,241 | B1 * | 4/2003 | Franchi | H02B 13/035 218/154 |
| 6,573,469 | B1 * | 6/2003 | Piazza | H02B 13/035 218/12 |
| 6,750,567 | B1 | 6/2004 | Elli et al. | |
| 2013/0057083 | A1 * | 3/2013 | Donzel | H01H 33/14 307/112 |
| 2015/0043121 | A1 | 2/2015 | Urai et al. | |

FOREIGN PATENT DOCUMENTS

WO WO 2013/150930 A1 10/2013

* cited by examiner

*Primary Examiner* — Jared Fureman
*Assistant Examiner* — James Evans
(74) *Attorney, Agent, or Firm* — Crowell & Moring LLP

(57) ABSTRACT

A method for controlling a power switching apparatus to solve problems including: setting a target time reaching a predetermined position immediately before a target phase by a time calculator during an opening and closing operation of a movable arc contact with respect to a fixed arc contact in a target phase at a predetermined average switching speed; and controlling an electric motor at a speed equal to or less than an average switching speed immediately before the target phase from an operation start time to the target time by a motor controller.

8 Claims, 5 Drawing Sheets

METHOD FOR CONTROLLING POWER SWITCHING APPARATUS

BACKGROUND OF THE INVENTION

Field of the Invention

The present invention relates to a method for controlling a power switching apparatus, and in particular, relates to a method for controlling a power switching apparatus suitable for performing a switching operation of a power switching apparatus for power transmission or power distribution network such as a breaker by an electric motor.

Background Art

In general, spring force or hydraulic pressure is used for an operation unit of a power switching apparatus, but from recent demand for saving operation force, an operation technique by an electric motor, in which operability is excellent and improvement of reliability is expected by reducing the number of components, has been developed. For example, a technique, in which a current value flowing through a main circuit conductor is detected, the detected current value and a threshold are compared to each other, and an operation force of an electric motor is controlled based on a magnitude thereof, is described in International Publication No. 2013/150930.

On the other hand, phase control for controlling timing for operating an operation unit with respect to a target phase of a current or a voltage during a switching operation is known. For example, a control method for delaying an operation start time so as to determine a switching operation time from phase information of a power system, and to match a target voltage phase and a pole closing time of an inputting operation within a certain range is described in U.S. Pat. No. 6,750,567.

SUMMARY OF THE INVENTION

However, a technique for controlling the operation force of the electric motor is described in International Publication No. 2013/150930, but a technique for realizing the switching operation having high reliability is not mentioned. On the other hand, in U.S. Pat. No. 6,750,567, in order to operate the operation unit in a predetermined switching time by providing a delay time, it is necessary to sufficiently increase a rated operation force and an allowance value with respect to a current value of a motor when correcting an operation with respect to influence received by the operation unit by friction between electrodes when starting the operation, aging, environmental changes, and the like.

The invention is made in view of the above points and an object of the invention is to provide a method for controlling a power switching apparatus in which a switching operation having high reliability can be realized in synchronization with a current or a voltage phase of a circuit network while suppressing a current value of a motor required for correction during a switching operation to be reduced.

According to an aspect of the present invention, in order to achieve the advantage described above, there is provided a method for controlling a power switching apparatus including a sealed tank that is filled with insulating gas, a breaking portion that is configured of a fixed arc contact provided in a fixed-side conductor disposed within the sealed tank and a movable arc contact coming into contact (pole closing) or separating (pole opening) with or from the fixed arc contact and provided in a movable-side conductor, an electric motor that generates a driving force for operating the movable arc contact, a drive circuit that drives the electric motor, a position detecting device that detects a position of an electric motor mover of the electric motor, a controller that controls at least one of a voltage, a current, and a phase supplied to the electric motor based on position information of the electric motor mover detected by the position detecting device, in which the controller includes a phase analysis portion that accumulates a time column of a current or a voltage of a circuit network from a current and voltage monitor detecting the voltage or the current of the circuit network from a predetermined time to a current time, and analyzes at least the phase, a time calculator that calculates a target time, and a motor controller that controls the electric motor via the drive circuit, the method for controlling a power switching apparatus including: setting a target time (Ts) reaching a predetermined position (Xs) immediately before a target phase by the time calculator during an opening and closing operation of the movable arc contact with respect to the fixed arc contact in the target phase at a predetermined average switching speed; and controlling the electric motor at a speed equal to or less than the average switching speed immediately before the target phase from an operation start time (T0) to the target time (Ts) by the motor controller.

According to the invention, it is possible to realize the opening and closing operation having high reliability in synchronization with the current or the voltage phase of the circuit network while suppressing the motor current value required for correction to be small during the opening and closing operation.

DETAILED DESCRIPTION OF THE INVENTION

Hereinafter, a method for controlling a power switching apparatus of the invention will be described based on illustrated examples. Moreover, the following are merely examples and contents of the invention are not intended to be limited to specific embodiments. The invention itself can be implemented in various embodiments as long as the embodiments are adaptable to contents described in the claims.

EXAMPLE 1

Figure 1A:
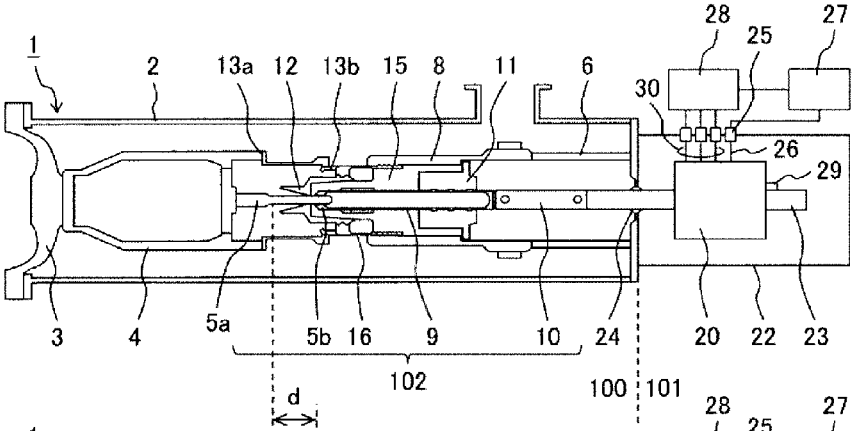
FIGS. 1A and 1B are sectional views illustrating a gas breaker as an example of a power switching apparatus to which a method for controlling a power switching apparatus of the invention is applied.
Figure 1B:
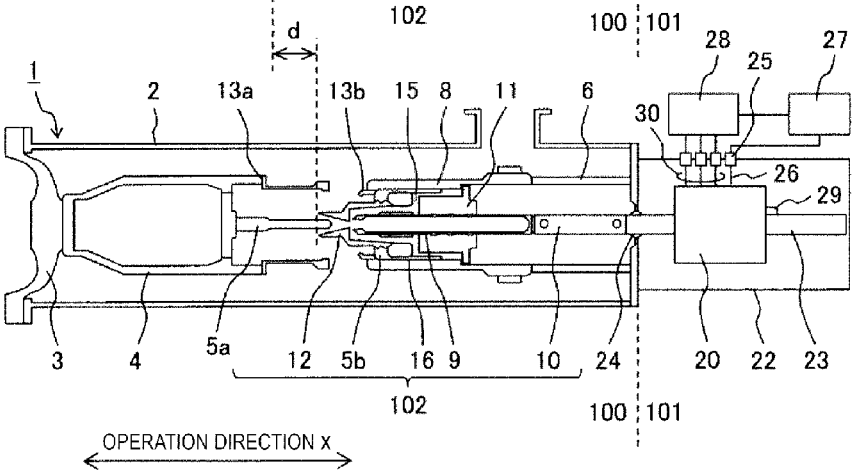

FIG. 1 illustrates a configuration of a gas breaker 1 that is an example of a power switching apparatus realizing a method for controlling a power switching apparatus of the invention. (a) of FIG. 1 illustrates an input state of the gas breaker 1 and (b) of FIG. 1 illustrates a break state of the gas breaker 1 in which a movable arc contact is relatively moved with respect to a fixed arc contact 5*a* by a distance d.

As illustrated in (a) and (b) of FIG. 1, the gas breaker 1 of the example is broadly divided into a breaking portion 100 for breaking a fault current or connecting a different circuit network (for example, power system) and an operation portion 101 for operating the breaking portion 100.

The breaking portion 100 is schematically configured of a fixed-side conductor 4 that is fixed to an insulating spacer 3 provided in an end portion of a sealed tank 2, a fixed main contact 13*a* that is provided at a tip of the fixed-side conductor 4, a movable main contact 13*b* that is disposed to face the fixed main contact 13*a* and comes into contact (pole closing) or separates (pole opening) with or from the fixed main contact 13*a*, the fixed arc contact 5*a* that is disposed in the fixed-side conductor 4, a movable arc contact 5*b* that is disposed to face the fixed arc contact 5*a* and comes into contact (pole closing) or separates (pole opening) with or from the fixed arc contact 5*a*, a movable-side conductor 8 in which the movable arc contact 5*b* is provided via a movable electrode 16, a nozzle 12 that is provided at a tip of the movable arc contact 5*b* and extinguishes arc generated between the fixed arc contact 5*a* and the movable arc contact 5*b* during pole opening by blowing extinguishing gas, an insulating cylinder 6 that is connected on the operation portion 101 side and is disposed so as to cover an insulating rod 10 connected from the movable-side conductor 8 via a puffer shaft 9, and a main circuit conductor (not illustrated) that is connected to the movable main contact 13*b* and configures a part of a main circuit within the sealed tank 2 filled with $SF_6$ gas that is insulating gas within an inside thereof. Moreover, reference numeral 11 is a puffer piston.

In the breaking portion 100, the movable main contact 13*b*, the movable arc contact 5*b*, the movable electrode 16, the nozzle 12, and the puffer shaft 9 are a movable portion 102. The movable portion 102 is moved in a direction of an arrow x (hereinafter, referred to as x direction) in the view by receiving an operation force from the operation portion 101 via the insulating rod 10. The movable main contact 13*b* is electrically switched with respect to the fixed main contact 13*a* and the movable arc contact 5*b* is electrically switched with respect to the fixed arc contact 5*a*, and thereby breaking (pole opening) and inputting (pole closing) of a current are performed. In this case, the movable main contact 13*b* is disposed to be opened earlier than the movable arc contact 5*b* during a breaking operation and the movable main contact 13*b* is disposed to be closed later than the movable arc contact 5*b* during an inputting operation.

On the other hand, the operation portion 101 is schematically configured of an operation unit case 22 that is provided adjacent to the tank 2, an electric motor (for example, linear motor) 20 that is disposed within the operation unit case 22, an electric motor mover 23 of the electric motor 20 that is disposed within the electric motor 20, a position detecting device 29 that is disposed in a periphery of the electric motor mover 23 and detects a position of the electric motor mover 23, a controller 27 that controls at least one of a voltage, a current, and a phase supplied to the electric motor 20 based on position information of the electric motor mover 23 detected by the position detecting device 29, and a drive circuit 28 that drives the electric motor 20 by receiving a control signal from the controller 27.

Then, the electric motor mover 23 is connected to the insulating rod 10 of the breaking portion 100 through a gas seal unit 24 that is provided so as to be driven while maintaining airtightness of the sealed tank 2 (gas seal unit 24 allows an operation of the electric motor mover 23 and maintains the airtightness in the sealed tank 2).

In addition, the electric motor 20 is configured to electrically connect to a control cable 26 including motor connection lines and a cable of the position detecting device 29 through a sealed terminal 25 provided so as to allow wiring connection to the drive circuit 28 on the outside of the operation unit case 22 while maintaining the airtightness in the operation unit case 22, and the control cable 26 is connected to the controller 27 and transmits a position signal to the controller 27.

The breaking operation of the breaker in the example will be described with reference to FIG. 1.

(a) of FIG. 1 illustrates the input state of the gas breaker 1 and the fixed main contact 13*a*, the movable main contact 13*b*, the fixed arc contact 5*a*, and the movable arc contact 5*b* are closed. In this case, the current flows through the fixed main contact 13*a* and the movable main contact 13*b*. If the breaking operation is started to break the current, the movable portion 102 configured of the electric motor mover 23 of the electric motor 20, the insulating rod 10 leading to the electric motor mover 23, the puffer shaft 9 leading to the insulating rod 10, the movable main contact 13*b* leading to the puffer shaft 9, the movable arc contact 5*b*, the movable electrode 16, and the nozzle 12 is moved.

In addition, as illustrated in (b) of FIG. 1, first, the movable main contact 13*b* and the fixed main contact 13*a* are opened, and the current flows through the fixed arc contact 5*a* and the movable arc contact 5*b* while the electric motor mover 23 moves the distance d from the pole closing to the pole opening. Thereafter, the movable arc contact 5*b* and the fixed arc contact 5*a* are opened, and arc is generated between the movable arc contact 5*b* and the fixed arc contact 5*a*. In the gas breaker 1, the arc is extinguished by blowing $SF_6$ gas to the arc by compression of a puffer chamber 15 due to the breaking operation. (b) of FIG. 1 illustrates a fully breaking position.

In the inputting operation of the gas breaker 1, the movable portion 102 is moved while sucking $SF_6$ gas into the puffer chamber 15 and first, the movable arc contact 5*b* and the fixed arc contact 5*a* are closed. Furthermore, the electric motor mover 23 is moved to a fully inputting position after the movable main contact 13*b* and the fixed main contact 13*a* are closed.

In addition, the fixed-side conductor 4, the fixed arc contact 5*a*, and the fixed main contact 13*a* may be movable, and in this case, since a relative speed can be increased during the switching operation, it is possible to relatively reduce the operation force.

Figure 2:
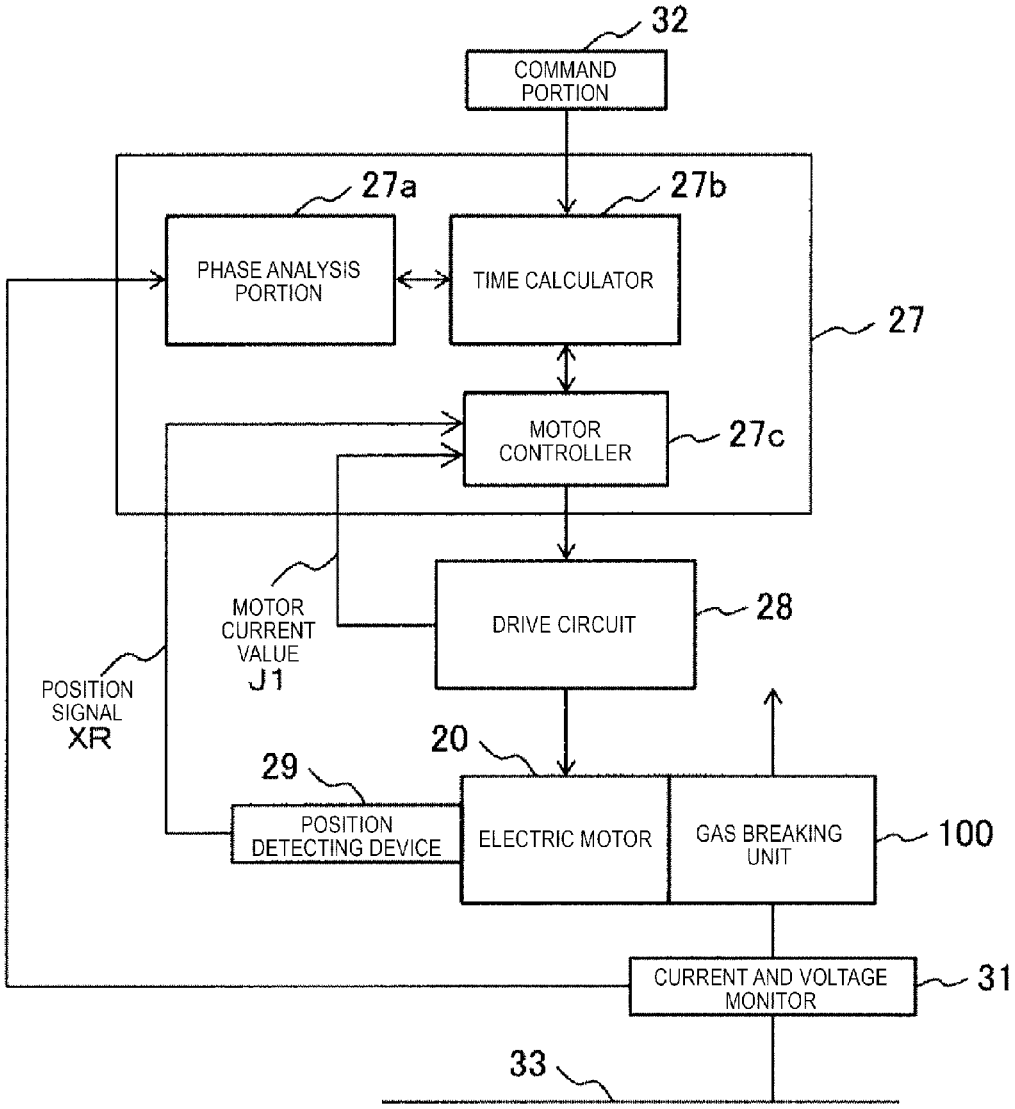
FIG. 2 is a diagram illustrating a detailed configuration of an operation unit and a controller causing a breaking portion connected to a circuit network to perform an opening and closing operation to realize the method for controlling the power switching apparatus of the invention.

FIG. 2 illustrates a detailed configuration of the operation portion 101 and the controller 27 causing the breaking portion 100 connected to a circuit network (for example, power system) 33 to perform the switching operation.

In the view, the controller 27 includes a phase analysis portion 27*a* that accumulates a time column of the current or the voltage of the circuit network 33 from a current and voltage monitor 31 from a predetermined time to a current time, and performs analysis about a frequency, a phase, modulation, and the like, a time calculator 27*b* that calculates a target time, and a motor controller 27*c* that controls the electric motor 20 via the drive circuit 28.

The drive circuit 28 receives a control signal from the motor controller 27*c*, performs switching of internal elements as indicated by the signal and supplies a current from a power supply (not illustrated) to the electric motor 20. In addition, the position detecting device 29 grasps a position of the electric motor mover 23 by reading a position of an electric scale by a sensor attached to the electric motor mover 23 of the electric motor 20 and can transmit position information of the electric motor mover 23 to the motor controller 27*c*. The motor controller 27*c* executes speed control based on the position information. A motor current sensor is configured to be provided in the drive circuit 28, a motor current value detected by the motor current sensor is transmitted to the motor controller 27*c*, and the motor current value is reflected in the control of the electric motor 20. A driving force of the electric motor 20 is controlled by a q-axis current calculated from the motor current value and the motor phase, and a motor thrust is proportional to the q-axis current.

Figure 3:
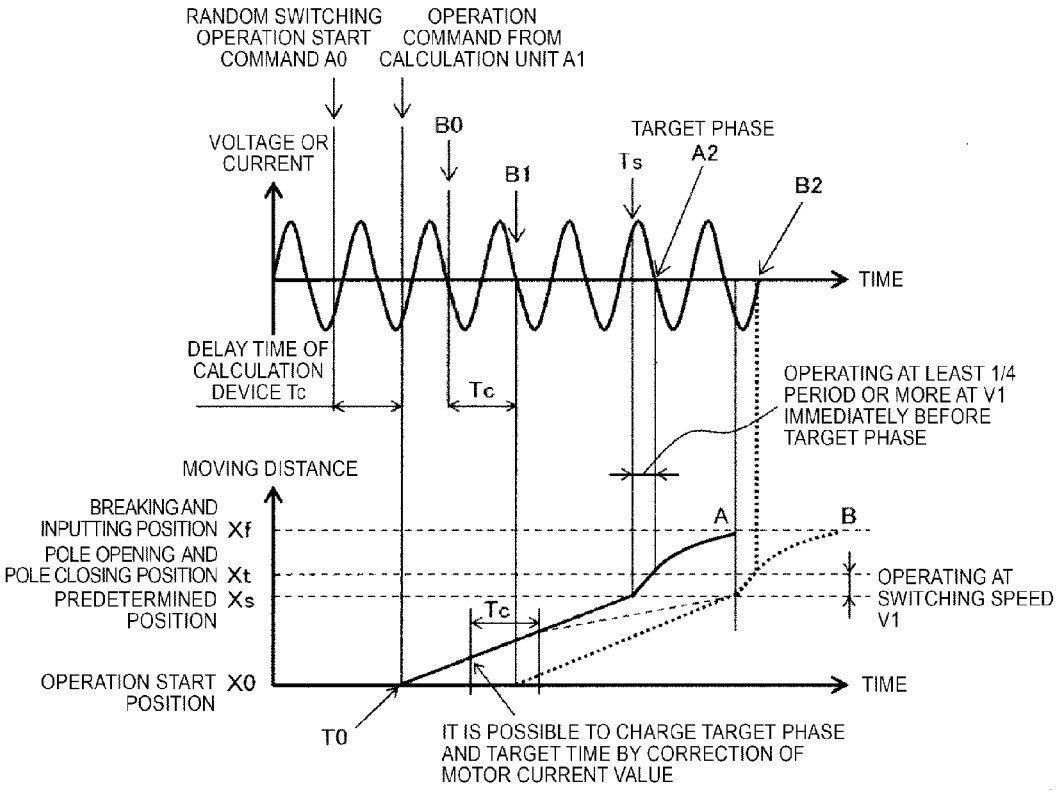
FIG. 3 is a diagram describing a current or voltage waveform and a calculation method of a target phase and a target time to be reached to a predetermined position immediately before the target phase with respect to timing when receiving a switching operation start command in the method for controlling the power switching apparatus of the invention.

FIG. 3 illustrates a current or voltage waveform and a calculation method of a target phase with respect to timing when receiving a switching operation start command and a target time Ts to be reached to a predetermined position Xs immediately before the target phase in the example.

That is, the electric motor mover 23 of the electric motor 20 is moved at an initial speed V0=(Xs−X0)/(Ts−T0) from a switching operation start position X0 to the predetermined position Xs reaching the target time Ts when a current time is T0 and is operated at the predetermined switching speed V1 from the predetermined position Xs to the pole opening and pole closing position.

The calculation method of the target phase and the target time will be described with reference to FIGS. 2 and 3.

In the views, if a random switching operation start command A0 is output from a command portion 32 to the time calculator 27*b*, the time calculator 27*b* receives the current or the voltage of the circuit network 33, and a period and/or phase information thereof from the phase analysis portion 27*a*, and calculates a reachable target phase and target time Ts such that a speed V of the electric motor mover 23 does not exceed the predetermined switching speed V1, and a motor current value J1 illustrated in FIG. 2 does not exceed a limit motor current value Jmax. If the switching operation start command from a calculation unit is B1, since the speed V exceeds the switching speed V1 in a target phase A2, the target phase becomes B2. That is, in FIG. 3, if a pole opening and pole closing position Xt in the target phase A2 exceeds the switching speed V1 and the switching operation start command is B1, it is seen that the target phase becomes B2 (dotted line in FIG. 3).

In addition, the predetermined switching speed V1 is determined by using the current or the voltage, and the frequency thereof, and the target time Ts depends on an insulation structure between electrodes and is a time before ¼ period. Moreover, the switching speed V1 may be an average speed.

Figure 4:
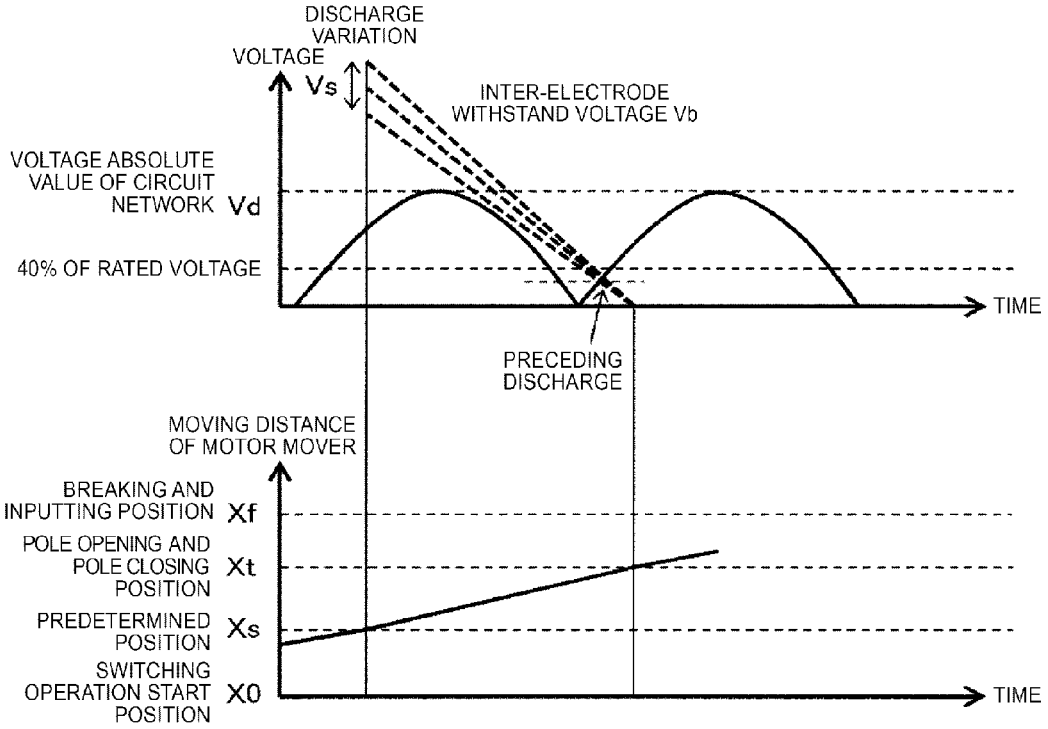
FIG. 4 is a diagram illustrating a calculation example of a switching speed according to the method for controlling the power switching apparatus of the invention.

The predetermined switching speed V1 described above is calculated by a rated voltage and an inter-electrode dielectric breakdown voltage of the circuit network. FIG. 4 illustrates a calculation example of the predetermined switching speed V1.

As illustrated in FIG. 4, in order to suppress preceding discharge, the inputting operation is performed to cause a voltage during preceding discharge to be equal to or less than 40% of the rated voltage. In this case, V1 of an inter-electrode withstand voltage Vb=Vs−Ex·V1 until it reaches 40% range of the rated voltage is calculated in a case in which a power supply voltage absolute value Vd is equal to or greater than Sin (2πft) (f [Hz] is frequency). Here, Vs is an inter-electrode withstand voltage at a predetermined position immediately before the target phase and Ex is an average electric field in this case. Actually, a minimum withstand voltage is used in consideration of variation in discharge.

In a case of the breaking operation, the switching speed V1 is maintained for at least ¾ cycles or more of time so that the inter-electrode withstand voltage is equal to or greater than three times the voltage of the circuit network.

Since the target phase is calculated for timing of an arbitrary switching operation start command, it is possible to realize the switching operation appropriately in synchronization with the target phase at any timing.

A speed from the switching operation start position X0 to the predetermined position Xs immediately before the target phase is equal to or less than the predetermined switching speed V1 (for example, equal to or less than half) and thereby it is possible to suppress the operation force and the motor current value required to be corrected when receiving external disturbance at a start of operation. Reduction of the required operation force and the motor current value extend the life of the apparatus and contribute to an improvement of reliability.

Constant acceleration from the switching operation start position X0 to the predetermined position Xs can be controlled. In this case, a speed change at the predetermined position Xs slopes gently (not straight) and thereby it is possible to suppress the motor current value.

Figure 5:
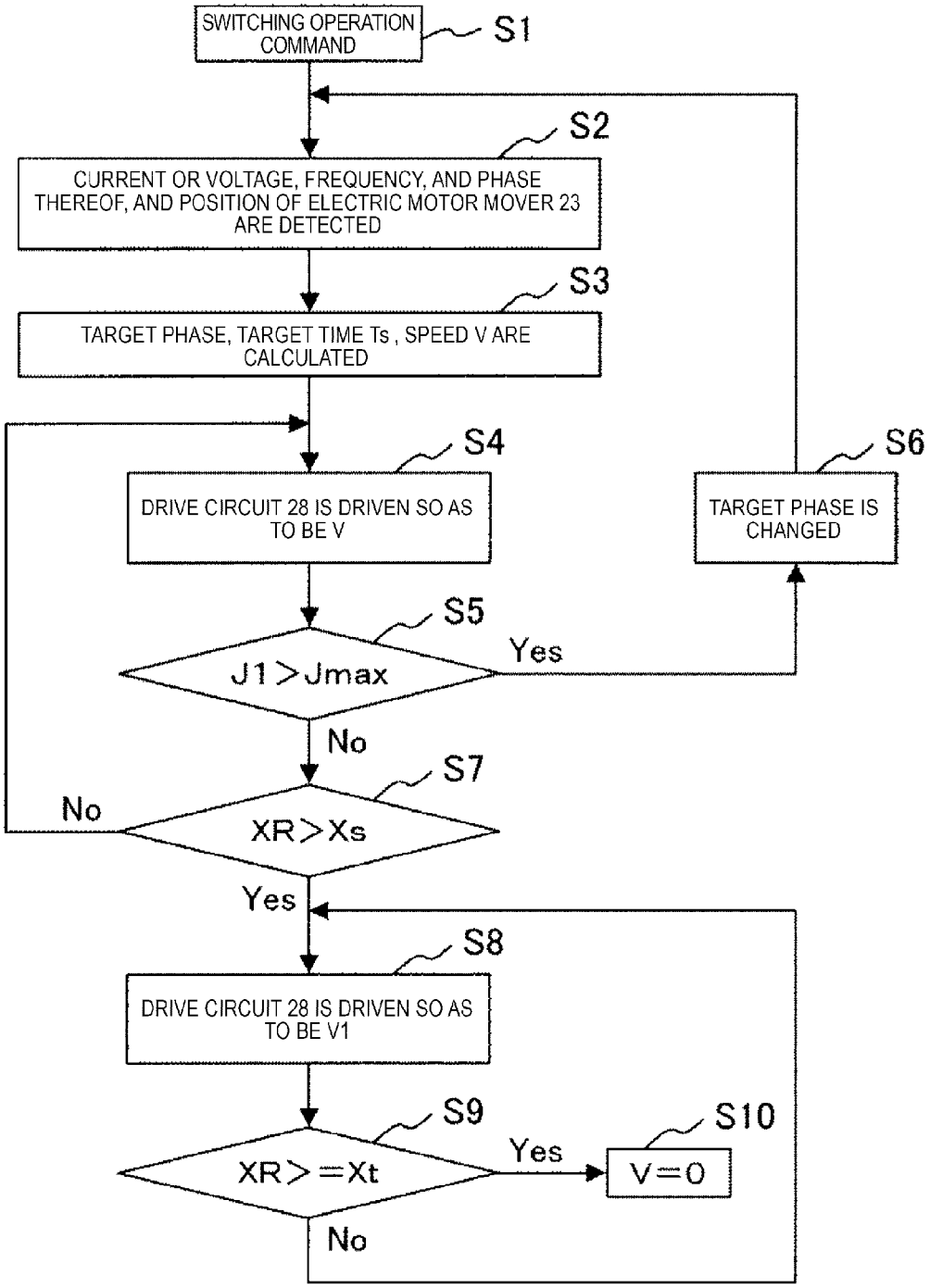
FIG. 5 is a flowchart illustrating a control flow according to the method for controlling the power switching apparatus of the invention.

FIG. 5 illustrates a control flow in the example. Details of the control flow in the example will be described with reference to FIGS. 2, 3, and 5. The control flow in the example is performed as follows.

That is, a first step (S1) in which the switching operation start command is output from the command portion 32 to the time calculator 27*b* illustrated in FIG. 2. A second step (S2) in which the current and voltage monitor 31 illustrated in FIG. 2 detects information about the circuit network 33 and the position detecting device 29 detects the position XR of the electric motor mover 23 of the electric motor 20. A third step (S3) in which the position detecting device 29 illustrated in FIG. 2 always monitors the position XR of the electric motor mover 23 detected in the second step (S2) and then the time calculator 27*b* calculates the target phase and the target time Ts immediately before a target operation from information of the circuit network 33, and the speed V determined from the predetermined position Xs immediately before the target phase. A fourth step (S4) in which the motor current value J1 realizing the speed V calculated in the third step (S3) is output to the motor controller 27*c*. A fifth step (S5) in which the motor current value J1 is compared to the limit motor current value Jmax. A sixth step (S6) in which if J1>Jmax in the fifth step (S5), the target phase is changed to the target phase of the next time and the target time Ts is calculated. A seventh step (S7) in which if J1<Jmax in the fifth step (S5), the position XR of the current electric motor mover 23 is compared to the predetermined position Xs. An eighth step (S8) in which if it is not XR>Xs in the seventh step (S7), the process returns to the fourth step (S4) and if XR>Xs in the seventh step (S7), the drive circuit 28 is driven so that the speed is the switching speed V1. A ninth step (S9) in which the position XR of the current electric motor mover 23 is compared to the pole opening and pole closing position Xt. A tenth step (S10) in which if it is not XR≥Xt in the ninth step (S9), the process returns to the eighth step (S8) and if XR≥Xt in the ninth step (S9), the speed V is controlled to be 0.

According to the method for controlling the power switching apparatus of the example described above, after the controller 27 receives the switching operation start command from the command portion 32 at any time, when a need for correction occurs during operation, it is possible to realize the switching operation in synchronization with the target phase of the current or the voltage of the circuit network 33 while suppressing the motor current value. In addition, it is possible to correct influence received by the operation unit by friction, aging, and environmental changes to a predetermined time from the operation start with further small operation force, and it is possible to increase reliability of the switching operation in synchronization with the target phase. Furthermore, it is possible to prevent a remarkable increase in the motor current value.

Therefore, effects, in which the switching operation having high reliability in synchronization with the current or the voltage phase of the circuit network can be realized while suppressing the motor current value required for correction to be small during the opening and closing operation, are obtained by adopting the example.

Moreover, the invention is not limited to the example described above and includes various modifications. That is, the above example is described in detail in order to easily illustrate the invention and is not limited to those necessarily including all described configurations. In addition, it is possible to replace a part of the configuration of an example with a configuration of another example and to add the configuration of the other example to the configuration of an example. In addition, for a part of the configuration of each example, it is possible to add, delete, and replace the other configuration.

What is claimed is:

1. A method for controlling a power switching apparatus including a sealed tank that is filled with insulating gas, a breaking portion that is configured of a fixed arc contact provided in a fixed-side conductor disposed within the sealed tank and a movable arc contact coming into contact (pole closing) or separating (pole opening) with or from the fixed arc contact and provided in a movable-side conductor, an electric motor that generates a driving force for operating the movable arc contact, a drive circuit that drives the electric motor, a position detecting device that detects a position of an electric motor mover of the electric motor, a controller that controls at least one of a voltage, a current, and a phase supplied to the electric motor based on position information of the electric motor mover detected by the position detecting device, wherein the controller includes a phase analysis portion that accumulates a time column of a current or a voltage of a circuit network from a current and voltage monitor detecting the voltage or the current of the circuit network from a predetermined time to a current time, and analyzes at least the phase, a time calculator that calculates a target time, and a motor controller that controls the electric motor via the drive circuit, the method for controlling a power switching apparatus comprising:

setting a target time (Ts) reaching a predetermined position (Xs) immediately before a target phase by the time calculator during an opening and closing operation of the movable arc contact with respect to the fixed arc contact in the target phase at a predetermined average switching speed; and controlling the electric motor at a speed equal to or less than the average switching speed immediately before the target phase from an operation start time (T0) to the target time (Ts) by the motor controller.

2. The method for controlling a power switching apparatus according to claim 1, wherein the drive circuit receives a control signal from the motor controller, performs switching of internal elements as indicated by the signal and supplies a current from a power supply to the electric motor, the position detecting device grasps a position of the electric motor mover by reading a position of an electric scale by a sensor attached to the electric motor mover and transmits the position information of the electric motor mover to the motor controller, and the motor controller executes speed control based on the position information.

3. The method for controlling a power switching apparatus according to claim 2, wherein a motor current sensor is provided in the drive circuit and a motor current value detected by the motor current sensor is transmitted to the motor controller and the electric motor is controlled.

4. The method for controlling a power switching apparatus according to claim 1, wherein the control method performs a first step in which a switching operation start command is output from a command portion to the time calculator, a second step in which the current and voltage monitor detects information about the circuit network and the position detecting device detects a position (XR) of the electric motor mover, a third step in which the position detecting device always monitors the XR detected in the second step and then the time calculator calculates the target phase and the target time (Ts) immediately before a target operation from information of the circuit network, and a speed (V) determined from the predetermined position (Xs) immediately before the target phase, a fourth step in which a motor current value (J1) realizing the speed (V) calculated in the third step is output to the motor controller, a fifth step in which the motor current value (J1) is compared to a limit motor current value (Jmax), a sixth step in which if J1>Jmax in the fifth step, the target phase is changed to a target phase of the next time and the target time (Ts) is calculated, a seventh step in which if J1<Jmax in the fifth step, a current position (XR) of the electric motor mover is compared to the predetermined position (Xs), an eighth step in which if it is not XR>Xs in the seventh step, the process returns to the fourth step and if XR>Xs in the seventh step, the drive circuit is driven so that the speed is a switching speed (V1), a ninth step in which the XR is compared to a pole opening and pole closing position (Xt), and a tenth step in which if it is not XR≥Xt in the ninth step, the process returns to the eighth step and if XR≥Xt in the ninth step, the speed (V) is controlled to be 0.

5. The method for controlling a power switching apparatus according to claim 1, wherein the electric motor mover is moved at an initial speed V0=(Xs−X0)/(Ts−T0) from a switching operation start position (X0) to the predetermined position (Xs) reaching the target time (Ts) when a current time is T0 and is operated at the predetermined switching speed (V1) from the predetermined position (Xs) to the pole opening and pole closing position.

6. The method for controlling a power switching apparatus according to claim 1, wherein the target time (Ts) reaching the predetermined position (Xs) immediately before the target phase is set to a time within ¼ period immediately before the target phase.

7. The method for controlling a power switching apparatus according to claim 1, wherein if the motor current value exceeds the limit motor current value within a time until the target time after the switching operation is started, the target phase is delayed by at least a half period and the target phase and the target time (Ts) reaching the predetermined position immediately before the target phase are recalculated.

8. The method for controlling a power switching apparatus according to claim 1, wherein the speed (V0) from the switching operation start position (X0) to the predetermined position (Xs) causes the electric motor mover to be controlled in a constant acceleration at equal to or less than the limit motor current value.

* * * * *